US005678823A

United States Patent [19]

Chaffee et al.

[11] Patent Number: 5,678,823

[45] Date of Patent: Oct. 21, 1997

[54] TOTAL SOLAR ECLIPSE GAME OF SKILL

[75] Inventors: Gerald F. Chaffee, So. Daytona; David Wise, Daytona Beach; Gary L. Wright, Ormond Beach, all of Fla.

[73] Assignee: Bob's Space Racers Inc., Daytona Beach, Fla.

[21] Appl. No.: 733,659

[22] Filed: Oct. 17, 1996

[51] Int. Cl.[6] ..... A63F 9/00

[52] U.S. Cl. ..... 273/371; 273/351; 273/448; 273/454; 273/456

[58] Field of Search ..... 273/448, 351, 273/371, 440, 445–447, 454, 456, 460

[56] References Cited

U.S. PATENT DOCUMENTS

| | | | |
|---|---|---|---|
| 1,225,787 | 5/1917 | Diehl | 273/351 |
| 4,039,184 | 8/1977 | Breslow et al. . | |
| 4,272,075 | 6/1981 | Rogers, Jr. . | |
| 4,432,544 | 2/1984 | Wakimura . | |
| 4,638,997 | 1/1987 | Clark . | |
| 5,072,936 | 12/1991 | Warehime . | |
| 5,082,274 | 1/1992 | Bright . | |
| 5,193,819 | 3/1993 | Chen . | |
| 5,209,486 | 5/1993 | Brotz . | |
| 5,553,859 | 9/1996 | Kelly et al. | 273/371 X |

FOREIGN PATENT DOCUMENTS

| | | | |
|---|---|---|---|
| 182397 | 5/1986 | European Pat. Off. | 273/371 |
| 4005940 | 8/1991 | Germany | 273/371 |
| 2207869 | 2/1989 | United Kingdom | 273/448 |

*Primary Examiner*—Paul E. Shapiro

*Attorney, Agent, or Firm*—Larson & Larson; James E. Larson

[57] ABSTRACT

A game of skill includes a lighted circular target intended to simulate the sun. A joystick is used to manipulate a crane mechanism and buttons are provided to allow the crane mechanism to be lowered and raised with an included magnet being used to allow lifting and dropping of magnetically attractive disks. The object of the game is to lift each disk, in turn, and to manipulate the joystick to cause disks to be dropped onto the simulated solar target surface to cover as high a percentage of the solar target surface as possible. An indicator is provided to indicate how much of the solar target surface has been covered, and a timer display displays the elapsed time.

20 Claims, 9 Drawing Sheets

TOTAL SOLAR ECLIPSE GAME OF SKILL

BACKGROUND OF THE INVENTION

1. Field of the Invention

The present invention relates to a game of skill. More particularly, to a total solar eclipse game. In the prior art, games of skill are known. However, Applicant is unaware of any such game including all of the features and aspects of the present invention.

2. Description of the Prior Art

The following prior art is known to Applicant:

U.S. Pat. No. 4,039,184 to Breslow et al.

U.S. Pat. No. 4,272,075 to Rogers, Jr.

U.S. Pat. No. 4,432,544 to Wakimura

U.S. Pat. No. 4,638,997 to Clark

U.S. Pat. No. 5,072,936 to Warehime

U.S. Pat. No. 5,082,274 to Bright

U.S. Pat. No. 5,193,819 to Chen

U.S. Pat. No. 5,209,486 to Brotz.

None of these references, taken alone or in combination, teaches the present invention, to-wit, an implement controlled by control means allowing movements in three dimensions to cause a lit target to be incrementally covered by target obscuring members.

SUMMARY OF THE INVENTION

The present invention relates to a total solar eclipse game. The present invention includes the following interrelated objects, aspects and features:

(1) In a first aspect, the inventive game includes a self-contained housing including a money receiving slot with a check control mechanism to verify validity of currency and coins, and a chamber viewable through a glass partition.

(2) Within the chamber, an electromagnet is suspended on a crane-like device and is controlled by control means allowing the electromagnet to be moved in three dimensions including vertically up and down, horizontally left to right, and horizontally front to back, with the device being capable of moving the electromagnet in a plurality of such directions simultaneously. The chamber includes a table having an illuminated circular target area that represents the sun. The solar target area is made of a translucent material and is illuminated from above.

(3) Below the solar target area, a multiplicity of light sensors are provided that sense the intensity of light emanating through the translucent material.

(4) Within the chamber, a plurality of magnetically attractive disks are disposed that may be sequentially engaged by the electromagnet to be moved to a location where they may be sequentially dropped onto the solar target area. As each disk is so dropped, the above-described light sensors sense partial obscuring of the solar target through blockage of light transmission through the translucent floor of the chamber. A numerical indicator is provided on a back wall of the chamber to indicate the cumulative percentage of obscuring of the solar target through the sequential depositing of magnetic disks thereover. In addition, an eclipse progress indicator is provided on the back wall of the chamber to indicate the cumulative percentage of obscuring proportional to the numerical indicator.

(5) When the game begins, a timer starts that times the duration of the game, preferably a time period such as, for example, 45 seconds to 1 minute. The time remaining is displayed on a time display, also preferably located on the back wall of the chamber.

(6) If desired, lights and sound effects may be provided to enhance the entertainment value of the inventive game.

As such, it is a first object of the present invention to provide a total solar eclipse game of skill.

It is a further object of the present invention to provide such a game wherein an electromagnet may be moved in three dimensions sequentially or simultaneously through manipulation of controls outside a game chamber.

It is a still further object of the present invention to provide such a game with a multiplicity of magnetically attractive disks that may be engaged, lifted and moved by the electromagnet and which may subsequently be released over a simulated solar surface target area.

It is a still further object of the present invention to provide such a game including a progress indicator indicating the percentage of the solar surface that has been covered, cumulatively.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
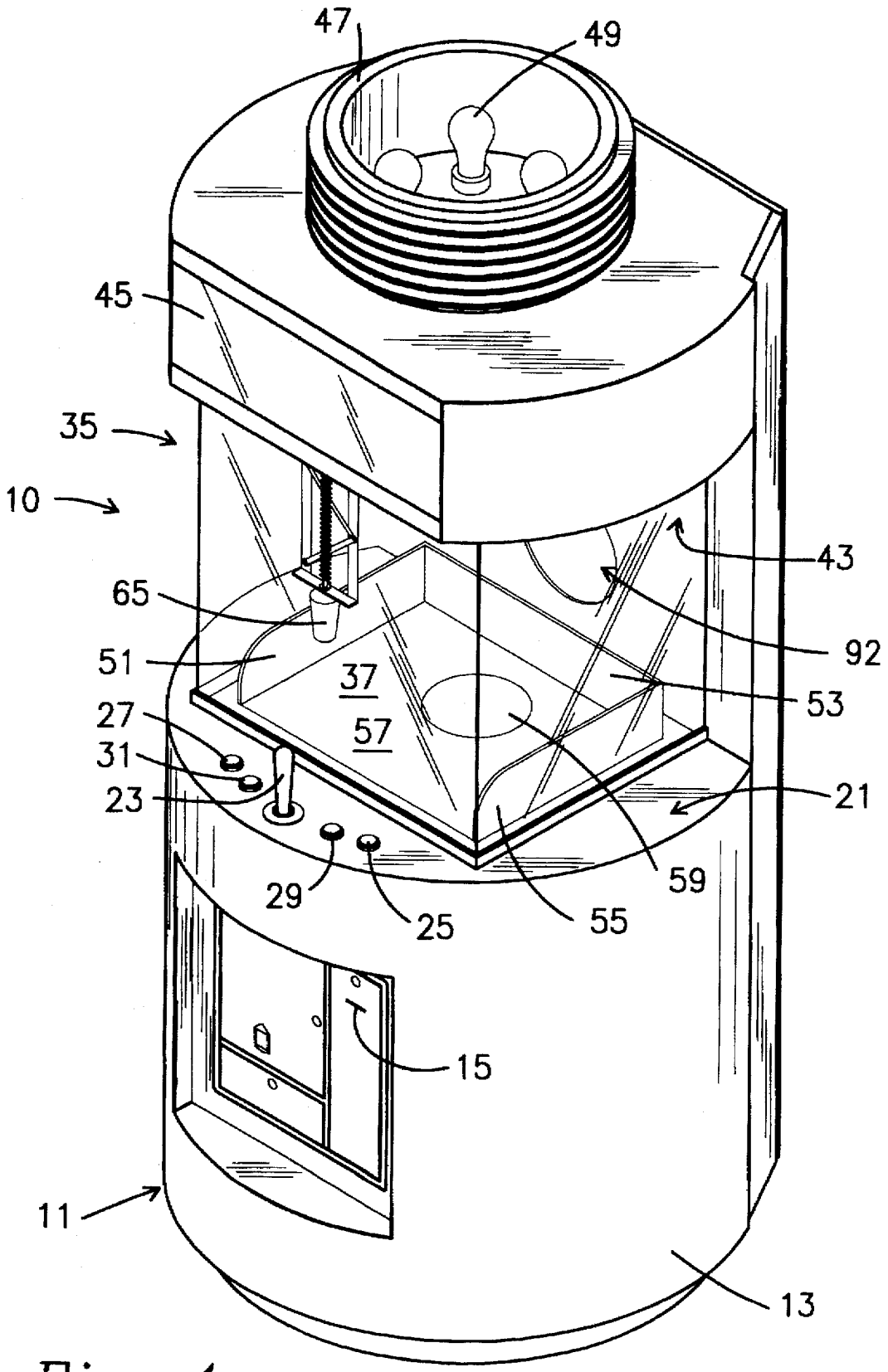
FIG. 1 shows a perspective view of the inventive game.
Figure 2:
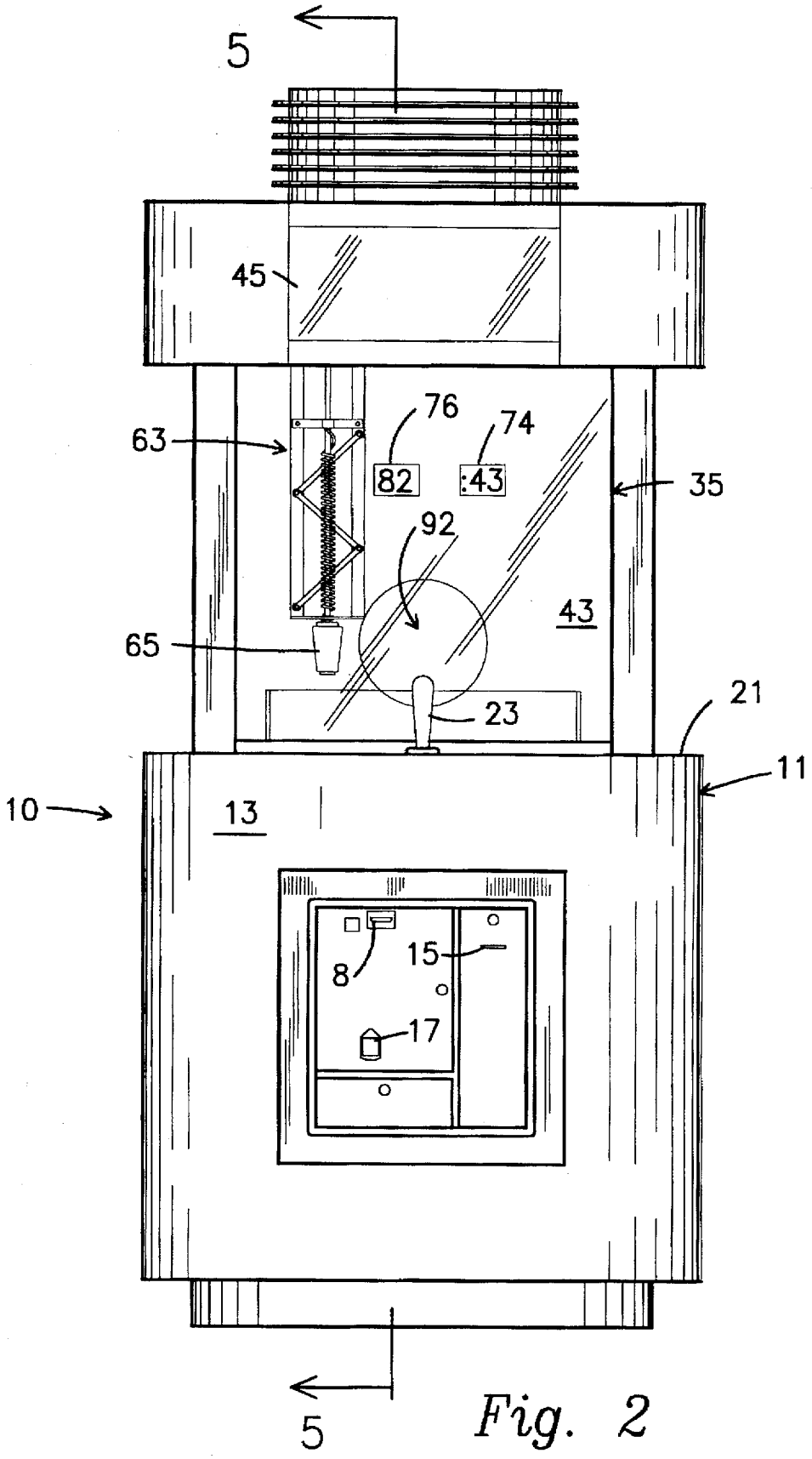
FIG. 2 shows a front view of the inventive game.
Figure 3:
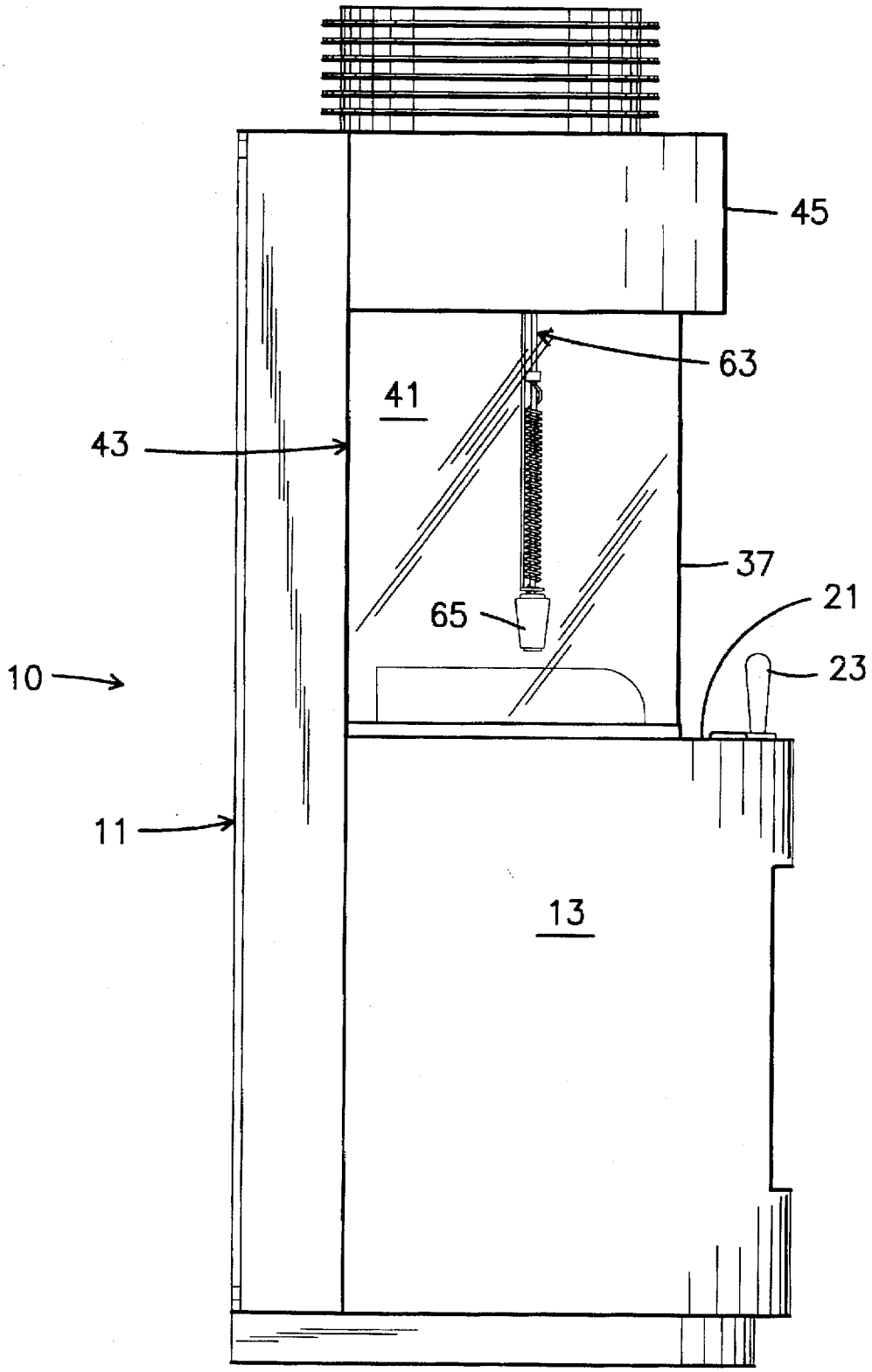
FIG. 3 shows a side view of the inventive game.
Figure 11:
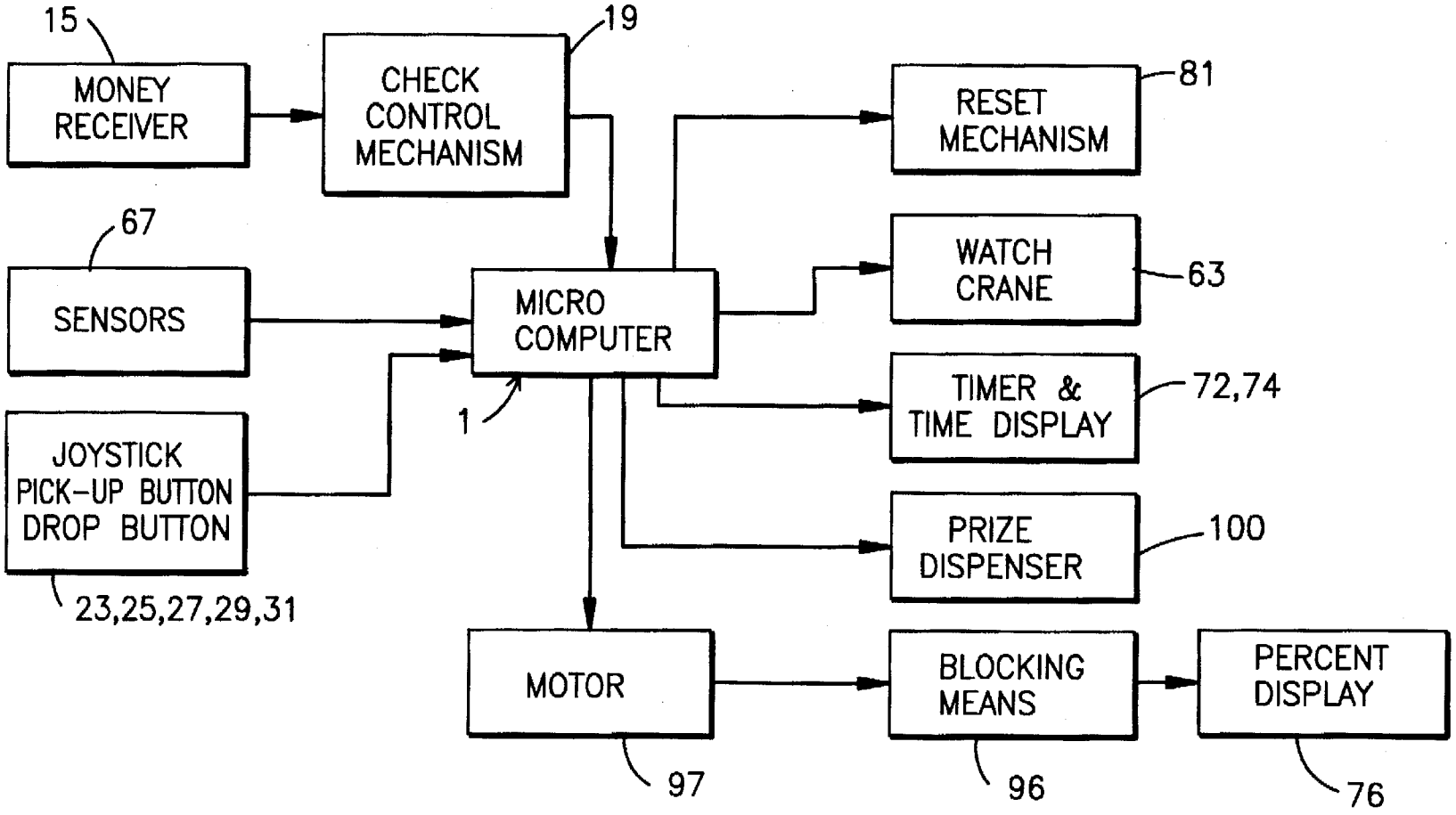
FIG. 11 shows a schematic representation of the electrical circuitry of the present invention.
Figure 12:
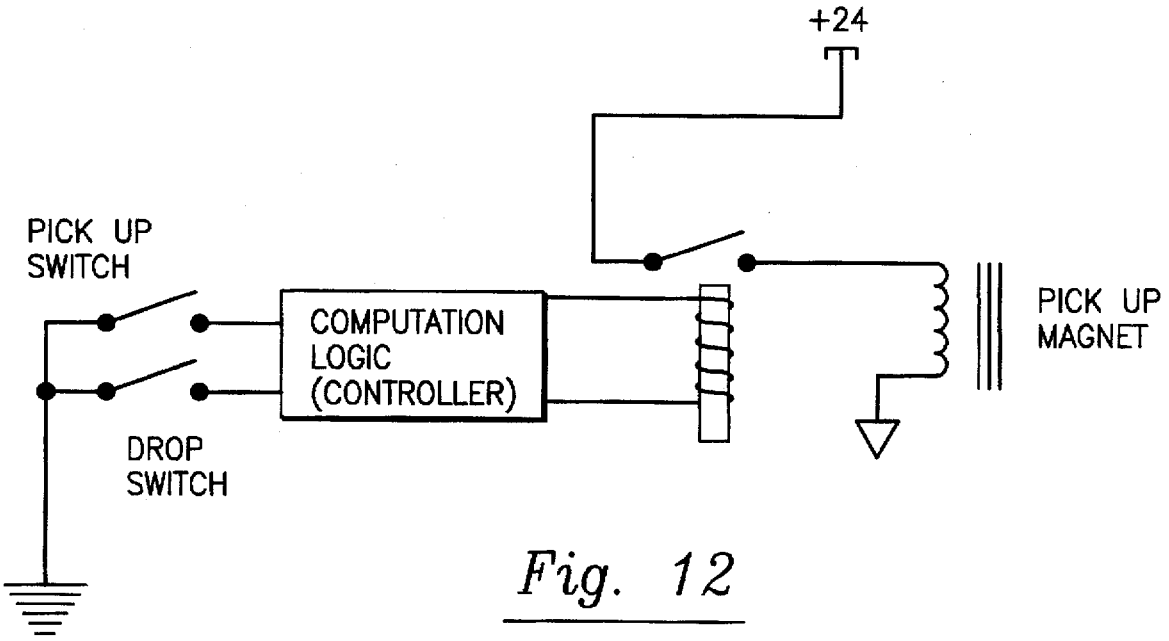
FIG. 12 shows a schematic representation of the electrical connections for the magnet employed in the present invention.

With reference, first, to FIGS. 1–3, the present invention is generally designated by the reference numeral 10 and is seen to include a housing 11 having a base 13 that contains a storage area (not shown) for storage of currency and coins. A coin slot 15 receives coins and a coin return slot 17 is also provided. If desired, a bill receiving mechanism (not shown) may also be employed. A check control mechanism 19 (FIG. 11) is located within the base 13 and checks the validity of coins (and bills) deposited therewithin. The top of the base 13 defines a surface 21 on which are mounted control means comprising a joystick controller 23, two pickup buttons 25 and 27, and two drop buttons 29 and 31. The buttons 25, 29, on the one hand, and 27, 31, on the other hand, are redundant and are provided to either side of the joystick controller 23 so that, for example, a person who wishes to grip the joystick controller 23 with their right hand will use the fingers of their left hand on the buttons 27, 31. Conversely, a user desiring to grip the joystick controller 23 with their left hand would use the fingers of their right hand to push the buttons 25, 29. It is understood that the placement of the two pickup buttons 25 and 27 and the two drop buttons 29 and 31 is shown in the preferred embodiment. Reverse placement of such buttons would still accomplish the same desired result by means of the same function in the same manner.

A chamber 35 is defined by transparent walls including a front wall 37, side walls 39 and 41, and a non-transparent rear wall 43 as well as a top portion 45 that covers the walls 37, 39, 41 and 43, and also includes a housing 47 that encloses illumination means, such as the lights 49 (FIG. 1), which may selectively illuminate to add entertainment value to the inventive game 10.

With further reference to FIGS. 1–3, within the chamber 35, a floor 57 is provided that is defined by surrounding walls 51, 53 and 55. These surrounding walls are preferably made of a transparent plastic material. The floor 57 includes a circular illuminated target region 59 made of a translucent material. The circular region 59 is illuminated so that it shines like the sun, as will be described in greater detail hereinafter. Such illumination for the circular region 59 preferably emanates from above within the top portion 45.

Within the chamber 35, manipulation means comprising a watch crane 63 is provided that includes an electromagnet 65 depending therefrom. The watch crane 63 is suspended on a controller mechanism 64 (FIG. 5) well known to those skilled in the art that responds to movements of the joystick controller 23 to allow movements of the electromagnet 65 left and right, front and back, or combinations of these two directions within two dimensions.

Depression of either of the pickup buttons 25 or 27 initiates a completed cycle resulting in lowering of the electromagnet to the floor 57, energization of the electromagnet 65 and subsequent lifting of the electromagnet 65 back to the elevation best seen with reference to FIGS. 2 and 3. The functional logic of such pickup cycle can be seen in FIG. 13. Depression of either one of the drop buttons 29 or 31, comprising a releasing means, results in de-energization of the electromagnet 65 so that a disk (to be described hereinafter) may be released therefrom and onto the surface 59. Referring again to FIG. 13, the functional logic of the drop cycle can be seen.

Figure 4:
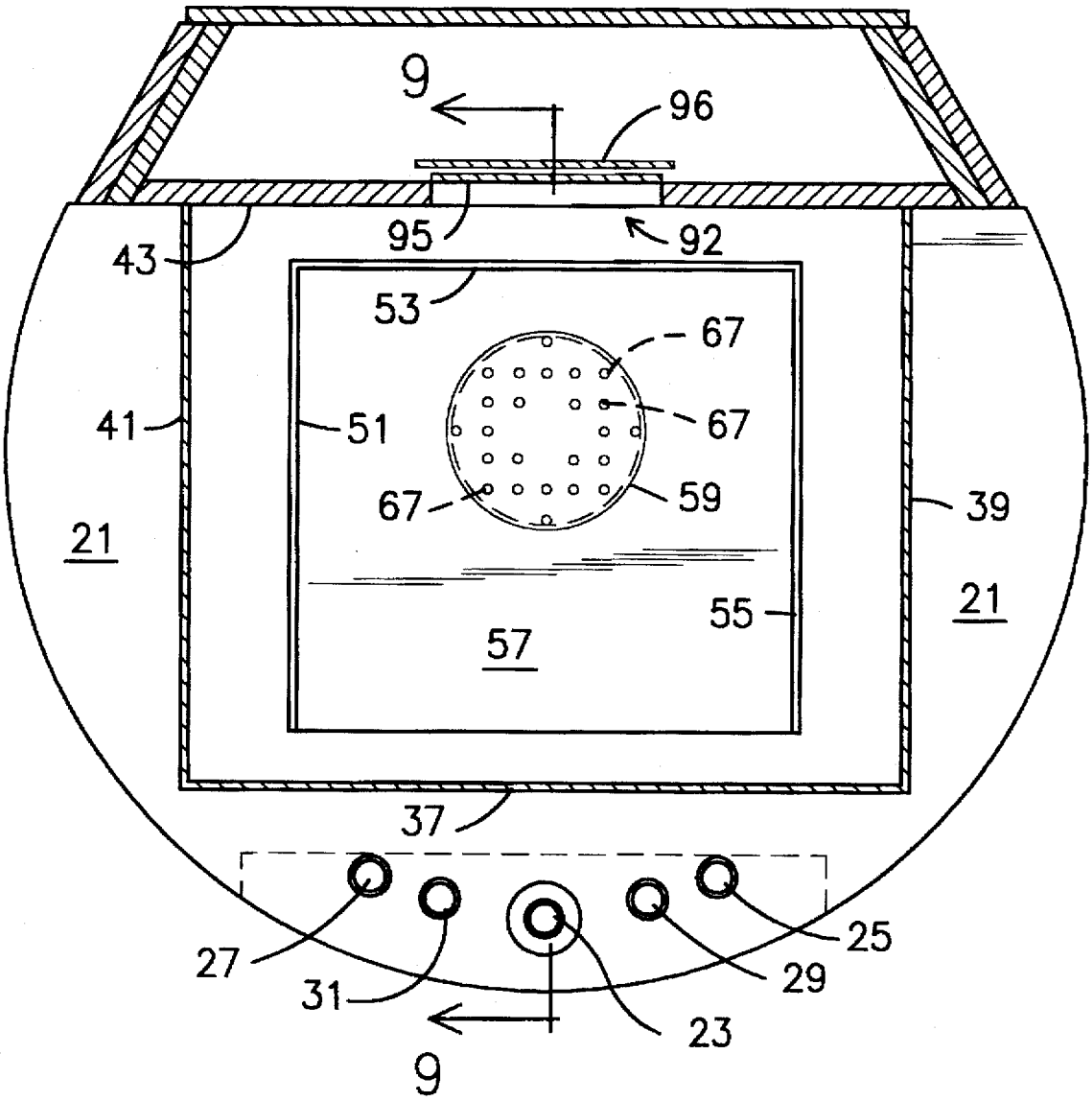
FIG. 4 shows a cross-sectional view along the line 4—4 of FIG. 5.

FIG. 4 is of particular interest as showing the solar surface target area 59 as having a multiplicity of light sensors 67 disposed about the surface thereof. These light sensors 67 sense the transmission of light through the translucent plastic surface 59. In the preferred embodiment, a multiplicity of photo-electric cells are used and are disposed in a generally grid-like pattern (see FIG. 4). As shown in FIG. 4, with no disks obscuring the surface 59, light transmission is 100%. As disks are dropped over the surface 59, the percentage of the surface through which light is transmitted reduces by a percentage that may be easily determined.

Figure 5:
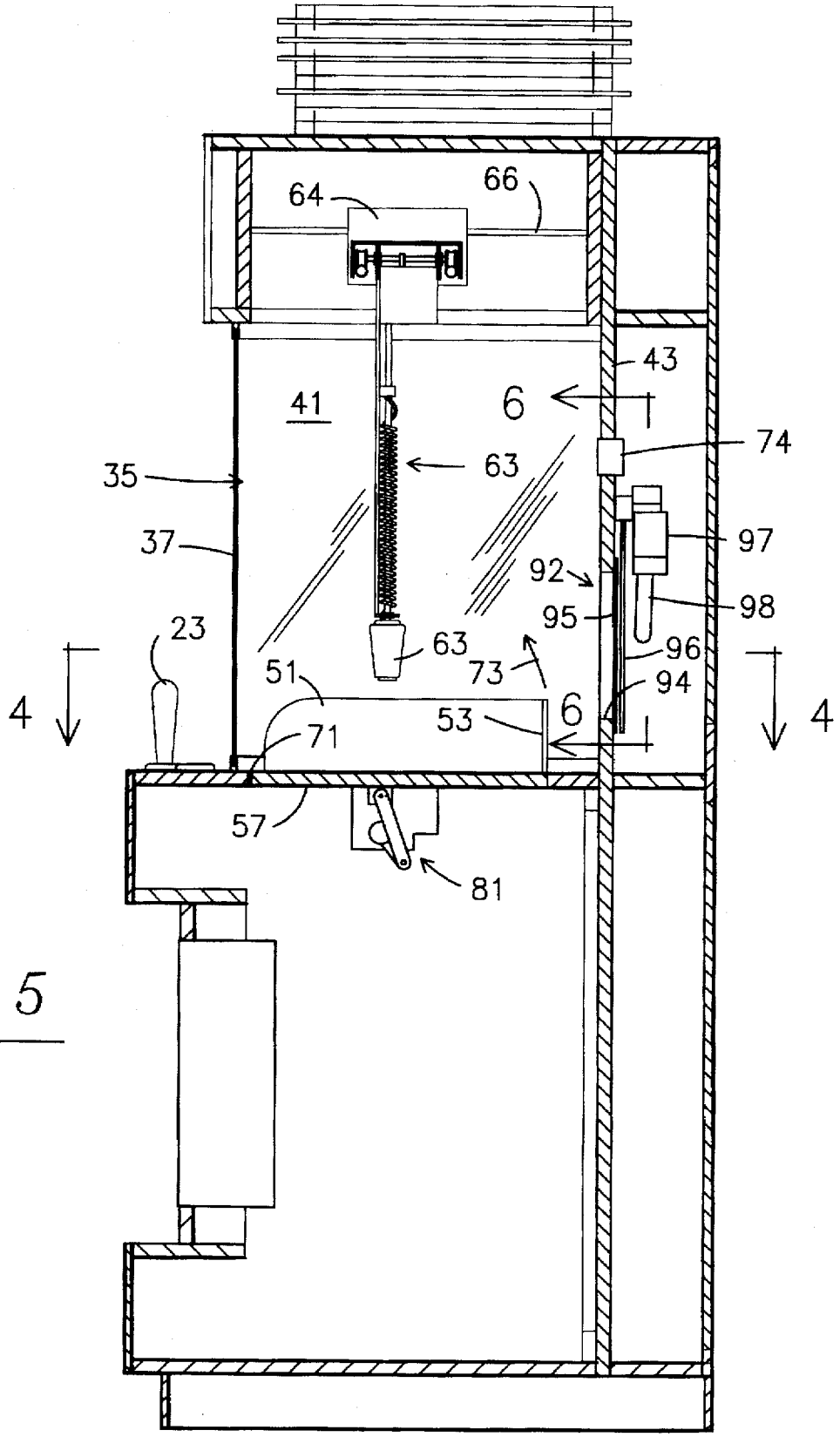
FIG. 5 shows a cross-sectional view along the line 5—5 of FIG. 2.

As shown in FIG. 5, the floor or game surface 57 is mounted within the chamber 35 through the use of a hinge 71 that allows the floor 57 to be pivoted in the direction of the arrow 73 (FIG. 5). Further, in this regard, reference is made to FIGS. 9 and 10 that show the floor 57, the hinge 71, the solar target area 59 covered with target obscuring means comprising disks 80, and a reset means or mechanism 81 consisting of a first arm 83 having one end 85 pivotably mounted to the undersurface of the game surface 57, a second end 87 of the first arm 83 pivotably mounted to a first end of a second arm 89 with the second arm 89 having a second end rigidly affixed to the drive shaft 93 of a motor 91 mounted on the bracket 90. As should be understood from comparison of FIGS. 9 and 10, when the motor 91 is activated, the drive shaft 93 rotates in the counterclockwise direction in the view of FIGS. 9 and 10 to cause extension of the arm 83 to cause pivoting of the floor 57 to the position shown in FIG. 10 whereupon the disks 80 slide under the force of gravity to a location adjacent the front wall 37 of the chamber 35. The direction of rotation of the shaft 93 is then reversed to restore the floor 57 to the position shown in FIG. 9. These operations of motor 91 are suitably controlled by a microcomputer 1. In the preferred embodiment, the motor is activated after a coin is received and validated.

Figure 7:
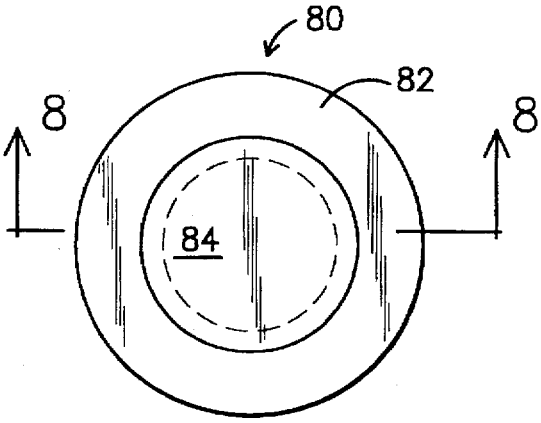
FIG. 7 shows a top view of a magnetically attractive disk in accordance with the teachings of the present invention.
Figure 8:
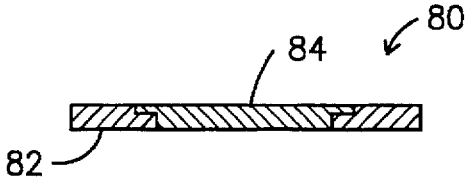
FIG. 8 shows a cross-sectional view along the line 8—8 of FIG. 7.

With reference to FIGS. 7 and 8, each of the disks 80 consists of an outer ring 82 of plastic material and a central disk or portion 84 made of a magnetically attractive material such as ferrous metal. FIG. 8 shows a preferred manner of interconnection of the ring 82 and the disk 84 to form a game disk 80.

Figure 6:
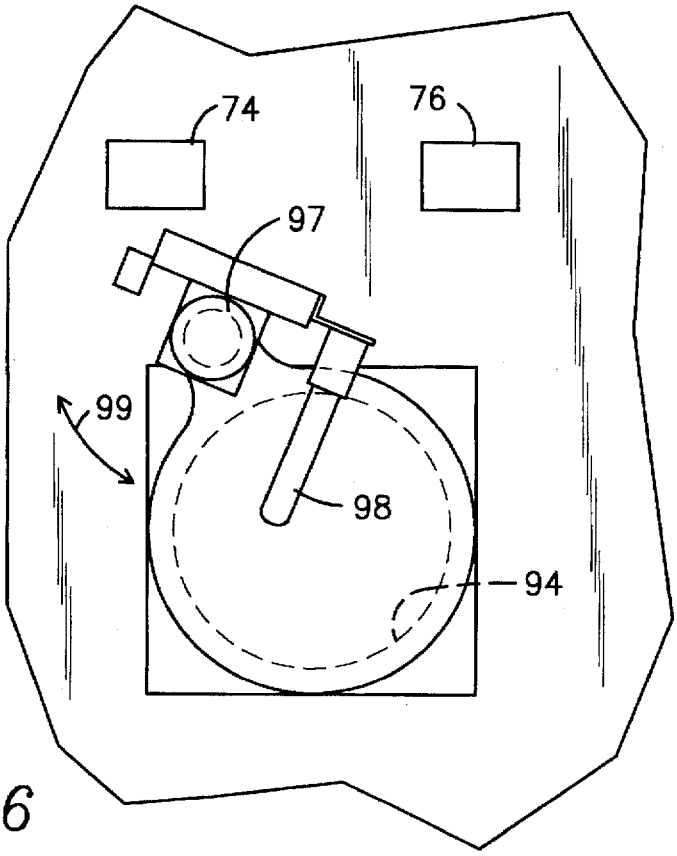
FIG. 6 shows a partial elevational view of the progress indicator.

With reference back to FIG. 1, it is seen that the rear wall 43 of the chamber 35 has a circular area 92 thereon which comprises an indicator or display means designed to display the percentage of the solar target area 59 that has been obscured through dropping of disks 80 thereon. In this regard, the indicator 92 consists of an opening 94 (FIG. 5) in the wall 43, a translucent plate 95 fixedly covering the opening 94, a solid plate 96 pivotably movable by rotations of the drive shaft of a pivoting means or motor 97, and illumination means consisting of a light 98 mounted behind the plate 96. As best understood with reference to FIG. 6, the plate 96 may be rotated in the two directions depicted by the arrow 99 through operation of the motor 97. As disks 80 are dropped on the simulated solar surface 59, various ones of the light sensors 67 are obscured. Signals are appropriately sent to the computer means or microcomputer 1 (FIG. 11) which receives these signals and causes activation of the motor 97 to rotate the plate 96 an incremental rotative distance to obscure an incremental amount of the opening 94 to obscure transmission of light from the source of light 98 therethrough by the same incremental amount, based upon the number of sensors 67 obscured by one or more disks 80. A digital percentage display 76 is also provided on the rear wall 43 (FIG. 2).

As also shown in FIG. 2, the rear wall 43 carries a time display 74 that shows the time remaining in a game starting with receipt of currency or coins and verification by the check control mechanism 19.

With the present invention having been described in detail hereinabove, a summary of the intended manner of operation thereof will now be set forth.

A user places coinage within the slot 15 or one or more bills within a bill receiving means (not shown). Any change that is due is received within the coin return slot 17. The check control mechanism 19 verifies the validity of the money paid and, upon such verification, the game is re-initialized. The initialization includes having the crane mechanism 63 return to a "home" position, clearing both progress indicators 76 and 92, resetting the timer 72 and raising and lowering the floor 57 as shown in FIGS. 9 and 10 such that the disks 80 are positioned proximal to wall 37.

Figure 9:
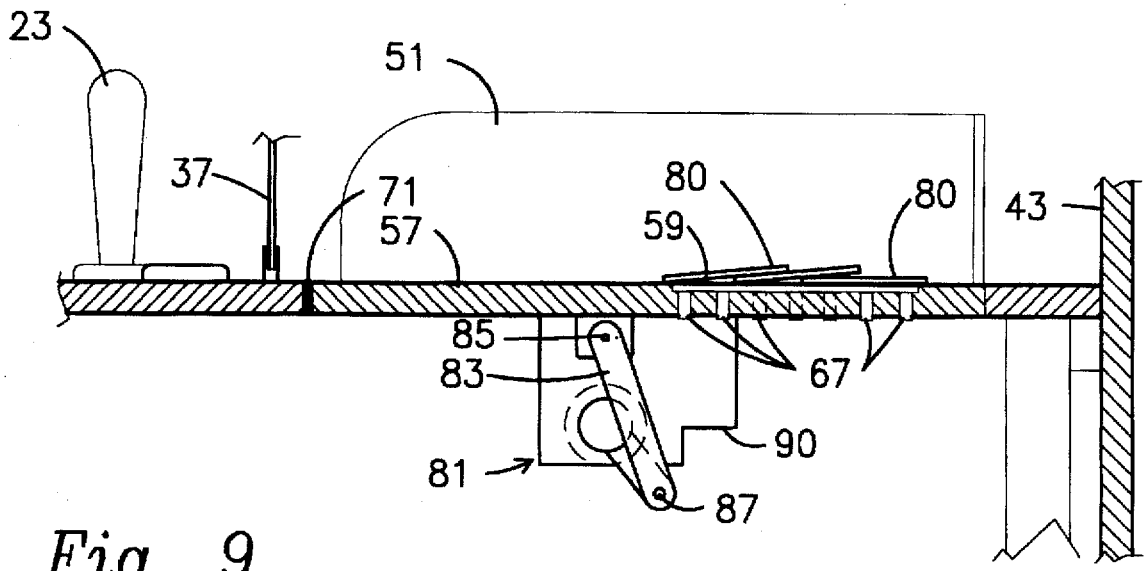
FIG. 9 shows a cross-sectional view along the line 9—9 of FIG. 4.
Figure 10:
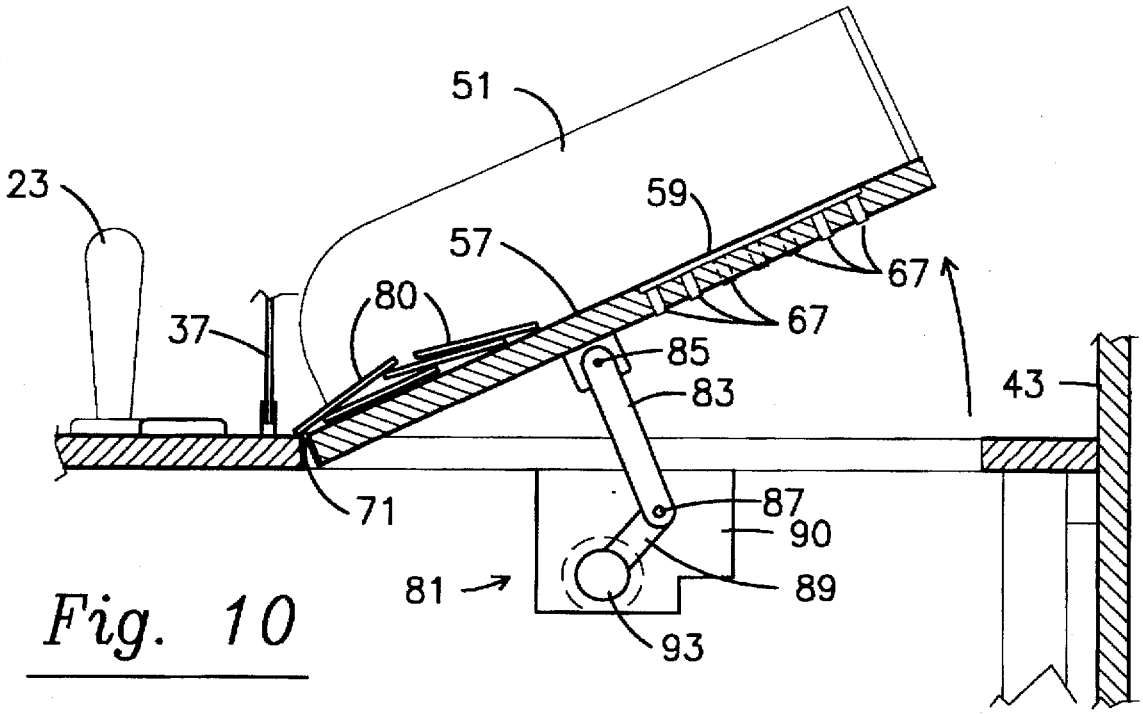
FIG. 10 shows a cross-sectional view similar to that of FIG. 9 but with the playing surface in a reset position.
Figure 13:
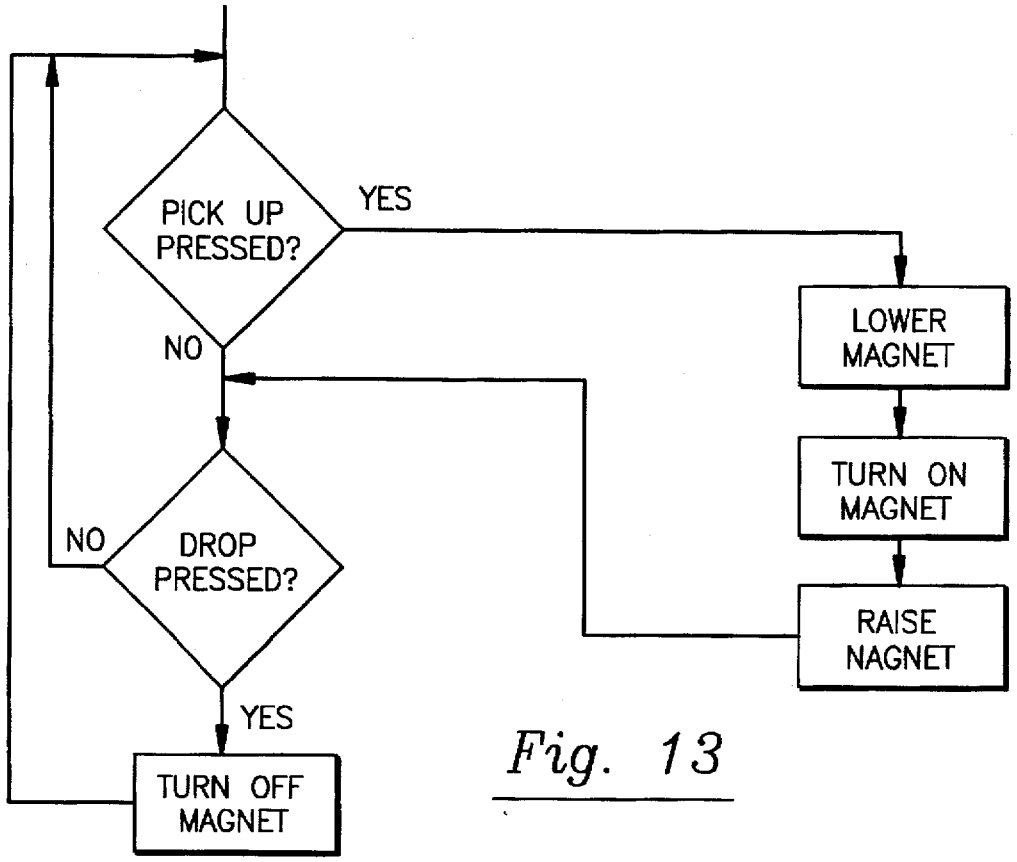
FIG. 13 shows a representation of the functional logic of the pickup and drop sequences of the present invention.

The game of the present invention will not be considered "started" until the floor 57 has returned to a horizontal position as seen in FIG. 9. The timer 72 then starts with the display 74 showing the time remaining in the game. With the multiplicity of disks 80, preferably five in number, positioned as shown in FIG. 10 but with the game surface 57 in the position shown in FIG. 9, the user may manipulate the joystick controller 23 in a manner well understood by those skilled in the art to cause horizontal movements of the watch crane 63 by virtue of operation of motors 64 which cause movements about cables 66 (FIG. 5). Operation of the crane mechanism 63 through operation of the motors 64 about the cables 66 is well known to those skilled in the art. When the electromagnet 65 is appropriately positioned over one of the disks 80, one of the pickup buttons 25, 27 is depressed starting a completed cycle as represented in the functional logic diagram of FIG. 13. Such completed cycle causes vertical lowering of the electromagnet 65 down to the floor 57, activation of the electromagnet 65, engagement with one of the disks 80, and lifting of the disk 80 as attached to the electromagnet 65 back to the elevation best seen with reference to FIGS. 2, 3 and 5. Thereafter, the joystick controller 23 may be manipulated as understood by those skilled in the art to move the watch crane 63 to a position suspended somewhere over the solar target area 59. When the watch crane 63 has been moved to a player desired location, one of the drop buttons 29 or 31 is depressed thereby deactivating the electromagnet 65, thereby causing the disk 80 to drop onto the solar target area 59 to partially obscure the solar surface 59 and overlie one or more light sensors 67. FIG. 13 includes a representation of the functional logic of the drop sequence. Signals emanate from the light sensor or sensors 67 that has or have been obscured, which signals are sent to the microcomputer 1 which causes appropriate control signals to be sent to the motor 97 to pivot the plate 96 (FIGS. 5 and 6) to a position partially overlying the opening 94 to give the user an indication of the percentage of obscuring of the solar target area 59 that has occurred by virtue of dropping of a disk 80 thereover. Concurrently, the microcomputer 1 sends signals to the percentage display 76 so that it correspondingly displays the percentage obscured.

The above-described process is repeated over and over again with each disk so long as time has not totally elapsed as displayed on the display 74. In the preferred embodiment, a perfect score is obtained if the player reaches a 99% coverage value. If the player has not reached a 99% coverage value of the solar target 59, the timer controls the end of play. In the preferred embodiment, the player is given 45 seconds. Accordingly, the object of the game 10 is to obscure the highest percentage of the solar surface 59 as is possible by placing as many of the disks 80 thereover during the time period that has been set for playing the game.

After the time period for playing the game has elapsed, the further display 76 adjacent the time display 74 displays the percentage of coverage of the solar target 59. If desired, the display 76 may continuously display the percentage obscured during the entirety of the playing of the game. If desired, (FIG. 11), a prize dispenser 100 may be included that dispenses a prize if the percentage displayed on the display 76 is above a pre-programmed threshold. Alternatively, a score above a pre-programmed percentage of obscuring may result in dispensing of a ticket allowing one or more free games. A ticket may also be dispensed from the slot 8 (FIG. 2) including, printed thereon, the percentage of obscuring of the simulated solar surface 59 obtained by the player.

After the time for playing the game has elapsed and the score has been displayed on the display 76, the microcomputer 1 deactivates the game. Upon entering the proper coin or bill, the game is re-initialized starting the reset mechanism 81 so that the motor 91 rotates the shaft 93 to lift the lever 83 and pivot the floor 57 about the hinge 71 to cause the disks 80 to slide to the position shown in FIG. 10, whereupon the direction of rotation of the shaft 93 may be reversed to cause the reset mechanism 81 to be restored to the orientation seen in FIG. 9 with the floor 57 restored to the position shown in FIG. 9, as well. The functions described above are schematically depicted with reference to FIG. 11.

Accordingly, an invention has been described in terms of a preferred embodiment thereof which fulfills each and every one of the objects of the invention as set forth hereinabove and provides a new and useful total solar eclipse game of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

We claim:

1. A game of skill, comprising:

a) a housing supporting a chamber defined by at least one wall and having a floor along a horizontal plane of the chamber;

b) an illuminated target region disposed upon the floor;

c) at least one target obscuring means disposed within the chamber for covering the illuminated target region;

d) manipulation means disposed within the chamber for magnetically engaging the target obscuring means and moving the target obscuring means to a position at least partially overlying the illuminated target region, the manipulation means including means for releasing the target obscuring means; and e) control means for controlling operation of the manipulation means including at least one manually operable control located outside the chamber.

2. The game of claim 1, wherein the target region is circular.

3. The game of claim 2, wherein the target obscuring means comprises a disk.

4. The game of claim 1, wherein the target obscuring means comprises a disk.

5. The game of claim 1, wherein the at least one target obscuring means comprises a plurality of disks.

6. The game of claim 1, wherein the manipulation means comprises a movable crane carrying an electromagnet at a lower portion, the releasing means including means for deactivating the electromagnet, the target obscuring means including a magnetically attractive portion.

7. The game of claim 1, wherein the floor is mounted in the chamber with a pivoting hinge, and further including reset means for pivoting the floor to cause the at least one target obscuring means to slide to a position adjacent the hinge.

8. The game of claim 1, further including display means for displaying a degree of obscuring of the target region by at least one target obscuring means.

9. The game of claim 8, wherein the display means comprises an opening in a wall of the chamber, a plate pivotably mounted behind the opening, means for pivoting the plate, and a light positioned behind the plate aligned with the opening, the pivoting means being actuated responsive to placement of a target obscuring means over a portion of the target region to display the degree of obscuring.

10. The game of claim 9, wherein the target region includes a multiplicity of light sensors disposed about the target region, each light sensor sensing when a target obscuring means has been placed thereover, and computer means for receiving signals from one or more of the sensors indicative of obscuring and, responsive thereto, actuating the pivoting means.

11. The game of claim 1, further including a timer for timing a game duration, and a time display for displaying actual remaining time.

12. The game of claim 10, further including a digital percentage obscured display for numerically displaying percentage obscuring of the target region.

13. A game of skill, comprising:

a) a housing supporting a chamber defined by at least one wall and having a floor disposed along a horizontal floor of the chamber;

b) the floor having an illuminated circular target region positioned on the floor;

c) a plurality of magnetically attractive disks disposed within the chamber;

d) manipulation means in the chamber comprising a movable crane carrying an electromagnet at a lower portion, the electromagnet engageable with the disks when actuated such to move the disk to a position at least partially overlying the target region, the crane including means for deactivating the electromagnet to release the disk over the target region;

e) control means for controlling operation of the manipulation means including a manually operable joystick as well as a first button for activating the electromagnet, and a second button for deactivating the electromagnet;

f) the floor being mounted in the chamber with a pivoting hinge, and further including reset means for pivoting the floor to cause the disks to slide to a position adjacent the hinge;

g) display means for displaying a degree of obscuring of the target region by at least one disk; and h) initialization means for returning the manipulation means to a home position, resetting the floor causing the disks to return to a position proximal to the control means, and resetting the display means.

14. The game of claim 13, wherein the display means comprises an opening in a wall of the chamber, a plate pivotably mounted behind the opening, means for pivoting the plate, and a light positioned behind the plate aligned with the opening, the pivoting means being actuated responsive to placement of a disk over a portion of the target region to display the degree of obscuring.

15. The game of claim 14, wherein the target region includes a multiplicity of light sensors disposed about the target region, each light sensor sensing when a disk has been placed thereover, and computer means for receiving signals from one or more of the sensors indicative of obscuring and, responsive thereto, actuating the pivoting means.

16. The game of claim 13, further including a timer for timing a game duration, and a time display for displaying remaining time.

17. The game of claim 13, further including a digital percentage obscured display for numerically displaying percentage obscuring of the target region.

18. A game of skill, comprising:

a) a housing supporting a chamber defined by at least one wall and having a pivotable floor disposed along a horizontal plane of the chamber, the floor having an illuminated target region positioned at a middle portion of the floor and pivotable about a hinge disposed along a front portion of the floor;

b) at least one magnetically attractive disk disposed within the chamber;

c) a movable crane carrying an electromagnet engageable with the at least one magnetically attractive disk when actuated such to move the disk to a position at least partially overlying the target region, the crane including means for deactivating the electromagnet to release the disk over the target region;

d) a manually operable control lever for operating the crane;

e) a first button for activating a completed pickup cycle including lowering the electromagnet carried on the crane from a retracted position, energizing the electromagnet for engaging the at least one magnetically attractive disk and raising the electromagnet having a disk magnetically attracted thereto back to the retracted position;

f) a second button for de-energizing the electromagnet releasing a disk magnetically attracted thereto;

g) a timer for timing a game duration;

h) a time display for displaying actual remaining time;

i) display means for displaying a degree of obscuring of the target region by the at least one magnetically attractive disk;

j) initialization means for returning the crane to a home position, pivoting the floor thereby causing the at least one disk to return to a position proximal to the control lever, resetting the timer and resetting the display means.

19. The game of claim 18, wherein the display means comprises an opening in a wall of the chamber, a plate pivotably mounted behind the opening, means for pivoting the plate, and a light positioned behind the plate aligned with the opening, the pivoting means being actuated responsive to placement of a disk over a portion of the target region to display the degree of obscuring.

20. The game of claim 19, wherein the target includes a multiplicity of light sensors disposed about the target region, each light sensor sensing when a disk has been placed thereover, and computer means for receiving signals from one or more of the sensors indicative of obscuring and, responsive thereto, actuating the pivoting means.

* * * * *